US010813822B1

(12) United States Patent
Bae et al.

(10) Patent No.: US 10,813,822 B1
(45) Date of Patent: Oct. 27, 2020

(54) UPPER ARM MODULE OF WEARABLE MUSCULAR STRENGTH ASSISTING APPARATUS AND WEARABLE MUSCULAR STRENGTH ASSISTING APPARATUS INCLUDING SAME

(71) Applicants: Hyundai Motor Company, Seoul (KR); Kia Motors Corporation, Seoul (KR)

(72) Inventors: Ki Hyeon Bae, Gyeonggi-do (KR); Hyun Seop Lim, Gyeonggi-do (KR); Beom Su Kim, Gyeonggi-do (KR); Ju Young Yoon, Gyeonggi-do (KR); Kyu Jung Kim, Seoul (KP); Dong Jin Hyun, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/691,225

(22) Filed: Nov. 21, 2019

(30) Foreign Application Priority Data

Apr. 4, 2019 (KR) ..... 10-2019-0039703

(51) Int. Cl.
*A61H 1/00* (2006.01)
*A61H 1/02* (2006.01)

(52) U.S. Cl.
CPC ..... *A61H 1/0274* (2013.01); *A61H 1/0277* (2013.01); *A61H 2201/0107* (2013.01);
(Continued)

(58) Field of Classification Search
CPC ..... A61H 1/0274; A61H 2201/1659; A61H 2201/165; A61H 1/00; A61H 1/02;
(Continued)

(56) References Cited

U.S. PATENT DOCUMENTS

2003/0223844 A1* 12/2003 Schiele ..... A61H 1/0274 414/5
2008/0009771 A1* 1/2008 Perry ..... B25J 9/0006 600/587

(Continued)

FOREIGN PATENT DOCUMENTS

KR 20170074814 A * 6/2017 ..... B25J 9/0006
KR 20180053276 A * 5/2018 ..... B25J 9/0006

(Continued)

OTHER PUBLICATIONS

KIPO search report Apr. 8, 2020 (Year: 2020).*

*Primary Examiner* — Quang D Thanh
(74) *Attorney, Agent, or Firm* — Mintz Levin Cohn Ferris Glovsky and Popeo, P.C.; Peter F. Corless

(57) ABSTRACT

An upper arm module of a wearable muscular strength assisting apparatus includes: a base part fixedly connected to a wearer's body; an upper arm part being configured such that a first end thereof is coupled to the base part to be rotatable about a fixed point, and being coupled to the wearer's upper arm to apply a rotational torque thereto; a first link configured such that a first end thereof is rotatably coupled to the base part at a point of application; a second link extending on a plane on which the upper arm part extends, and being rotatably coupled to a second end of the first link at a first point; a third link coupled to the second link at a second point to guide movement of the second point; and an elastic body generating an elastic force by deformation.

15 Claims, 11 Drawing Sheets

(52) U.S. Cl.
CPC ..... *A61H 2201/0157* (2013.01); *A61H 2201/1436* (2013.01); *A61H 2201/165* (2013.01); *A61H 2201/1659* (2013.01); *A61H 2201/1671* (2013.01)

(58) Field of Classification Search
CPC ..... A61H 1/0277; A61H 2205/06; A61H 2201/0107; A61H 2201/0157; A61H 2201/018; A61H 2201/12; A61H 2201/14; A61H 2201/1436; A61H 2201/1635; A61H 2201/1638; A61H 2201/1671; A61H 2201/1676; A61H 2201/5053; B25J 9/0006; B25J 9/06; B25J 9/08; B25J 9/14; B25J 9/106; B25J 9/109; B25J 9/1065; A61F 2/54; A61F 2002/543; A61F 2002/546
See application file for complete search history.

(56) References Cited

U.S. PATENT DOCUMENTS

2010/0217163 A1* 8/2010 Sankai ..... B25J 9/0006 601/5
2015/0076196 A1* 3/2015 Brown ..... F16M 11/2014 224/271
2016/0339583 A1* 11/2016 Van Engelhoven ... B25J 9/0006
2017/0144309 A1* 5/2017 Sankai ..... B25J 9/0006
2017/0173783 A1* 6/2017 Angold ..... B25J 9/0006
2018/0023758 A1* 1/2018 Bax ..... F16M 11/38 248/576
2019/0175435 A1* 6/2019 Sasaki ..... A61H 1/0281
2019/0350794 A1* 11/2019 Angold ..... A45F 3/08

FOREIGN PATENT DOCUMENTS

KR 101896181 B1 9/2018
WO WO-2019016629 A1 * 1/2019 ..... B25J 9/102

* cited by examiner

UPPER ARM MODULE OF WEARABLE MUSCULAR STRENGTH ASSISTING APPARATUS AND WEARABLE MUSCULAR STRENGTH ASSISTING APPARATUS INCLUDING SAME

CROSS REFERENCE TO RELATED APPLICATION

The present application claims under 35 U.S.C. § 119(a) the benefit of Korean Patent Application No. 10-2019-0039703, filed Apr. 4, 2019, the entire contents of which is incorporated by reference herein.

BACKGROUND

(a) Technical Field

The present disclosure relates to an upper arm module of a wearable muscular strength assisting apparatus and the wearable muscular strength assisting apparatus including the same, more particularly, to the upper arm module for supporting a wearer's upper arm by compensating for a load due to gravity.

(b) Description of the Related Art

A wearable robot is a robot that assists the movement of the body by putting the robot on a specific part of the body or by mounting the robot to the specific part, and is designed to be used for medical, military, or industrial purposes. In particular, in the case of wearable robots for work, they are designed to prevent injuries and to support muscle strength by reducing the load applied to the worker. The wearable robot typically is designed to mimic a wearer's exoskeleton, and a joint should have the same motion as the actual motion of the body.

In particular, a wearable muscular strength assisting apparatus includes a manual support mechanism configured to support a person supporting the weight of a tool. A typical manual support mechanism is configured to compensate for gravity under a range of positions by using a combination of structural elements, springs, cables, and pulleys. The configuration of these devices provides gravity compensation within a limited operating range of operation.

However, the conventional wearable muscular strength assisting apparatus is problematic in that a torque profile is formed by combining a cam and a wire, but the combination of the cam and the wire causes deterioration of assemblability and workability, and durability and noise problems occur due to friction and sliding between components.

The foregoing is intended merely to aid in the understanding of the background of the present disclosure, and is not intended to mean that the present disclosure falls within the purview of the related art that is already known to those skilled in the art.

SUMMARY

Accordingly, the present disclosure proposes an upper arm module of a wearable muscular strength assisting apparatus and the wearable muscular strength assisting apparatus including the same, in which a torque profile is formed by using a plurality of links without wires, thereby improving durability and assemblability.

In order to achieve the above object, according to one aspect of the present disclosure, there is provided an upper arm module of a wearable muscular strength assisting apparatus, the upper aim module including: a base part fixedly connected to a wearer's body, and positioned to correspond to an upper end portion of a wearer's upper aim; an upper arm part being configured such that a first end thereof is coupled to the base part to be rotatable about a fixed point, extending to correspond to the wearer's upper arm, and being coupled to the wearer's upper arm to apply a rotational torque to the wearer's upper arm; a first link configured such that a first end thereof is rotatably coupled to the base part at a point of application spaced apart from the fixed point; a second link extending on a plane on which the upper aim part extends, and being rotatably coupled to a second end of the first link at a first point; a third link coupled to the second link at a second point spaced apart from the first point of the second link to guide movement of the second point; and an elastic body being configured such that a first end thereof is coupled to the upper arm part at a position spaced apart from the first end of the upper aim part in an extension direction of the upper arm part, and a second end thereof is coupled to the second link at a third point spaced apart from the first point and the second point of the second link, and generating an elastic force by deformation.

The third link may be configured such that a first end thereof is rotatably coupled to the upper arm part, and a second end thereof is rotatably coupled to the second link at the second point spaced apart from the first point of the second link.

The upper aim module may further include a fourth link configured such that a first end thereof is rotatably coupled to the upper arm part, and a second end thereof is rotatably coupled to the first link at a position spaced apart from the first end of the first link.

The second end of the fourth link may be concurrently coupled to the first link and the second link at the first point of the second link.

The third link may further include a micro switch that is operated to be grounded or ungrounded as the third link is rotated about a first end thereof, wherein the micro switch may be coupled to an external device through a connector provided in the upper arm part.

The point of application may be disposed in the base part at a position above the fixed point, so a direction from the fixed point to the point of application may an upward sloping direction from the ground.

The upper arm module may further include: a fifth link configured such that a first end thereof is rotatably coupled to the second link between the second link and the elastic body, and a second end thereof is coupled to the second end of the elastic body; and a sixth link configured such that a first end thereof is rotatably coupled to the upper arm part between the elastic body and the upper aim part, and a second end thereof is coupled to the first end of the elastic body.

The elastic body may be constituted by a plurality of springs with opposite ends thereof being coupled to the fifth link and the sixth link, respectively, and the second end of the fifth link and the second end of the sixth link may extend along a direction in which the plurality of springs is disposed.

The rotational torque generated by the elastic force of the elastic body may be varied as the upper arm part is rotated about the fixed point, and may have a profile in which a magnitude of the rotational torque increases gradually as the upper arm part is rotated downward with respect to the base part, has a maximum value at a predetermined angle with respect to the ground, and then decreases again.

The third point of the second link may be spaced apart from a straight line connecting the first point and the second point such that the first point, the second point, and the third point form a triangle, and the first point and the second point of the second link may be moved such that the second link is rotated while being translated toward the fixed point as the upper arm part is rotated downward about the fixed point. As the upper arm part is rotated downward about the fixed point within an angle range greater than a predetermined angle with respect to the ground, the second link may be rotated in a direction in which the third point is away from the first end of the upper aim part.

As the upper arm part is rotated downward about the fixed point within an angle range smaller than a predetermined angle with respect to the ground, the second link may be rotated in a direction in which the third point approaches the first end of the upper arm part.

The third point of the second link may be disposed above the straight line connecting the first point and the second point, and as the upper aim part is rotated downward about the fixed point, the first point of the second link may be moved downward while being moved toward the fixed point and is moved upward, and the second point may be gradually and quickly moved downward while being moved toward the fixed point.

The upper arm module may further include a rotatable part relatively rotatably coupled to the base part about the fixed point, and configured such that rotation of the rotatable part relative to the base part is restrained when locked by a locking mechanism, wherein the first link may be rotatably coupled to the rotatable part at the point of application such that the first link and the upper arm part are rotated simultaneously as the rotatable part is rotated relative to the base part.

The locking mechanism may allow the rotatable part to be locked to the base part at multiple rotation angle points.

In order to achieve the above object, according to another aspect of the present disclosure, there is provided a wearable muscular strength assisting apparatus, which includes the upper arm module, the wearable muscular strength assisting apparatus configured such that the base part is coupled to a wearer's torso through a plurality of fastening mechanisms.

According to an upper arm module of a wearable muscular strength assisting apparatus and a wearable muscular strength assisting apparatus including the same of the present disclosure, only with the configuration of the simple connecting links and the elastic body, it is possible to realize a torque profile that varies the rotational torque that rotates the upper arm part of the wearer upward according to the angle of the upper arm part.

It is further advantageous in that it is possible to improve durability and assemblability by using links without using wires and cams.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION OF THE DISCLOSURE

Figure 1:
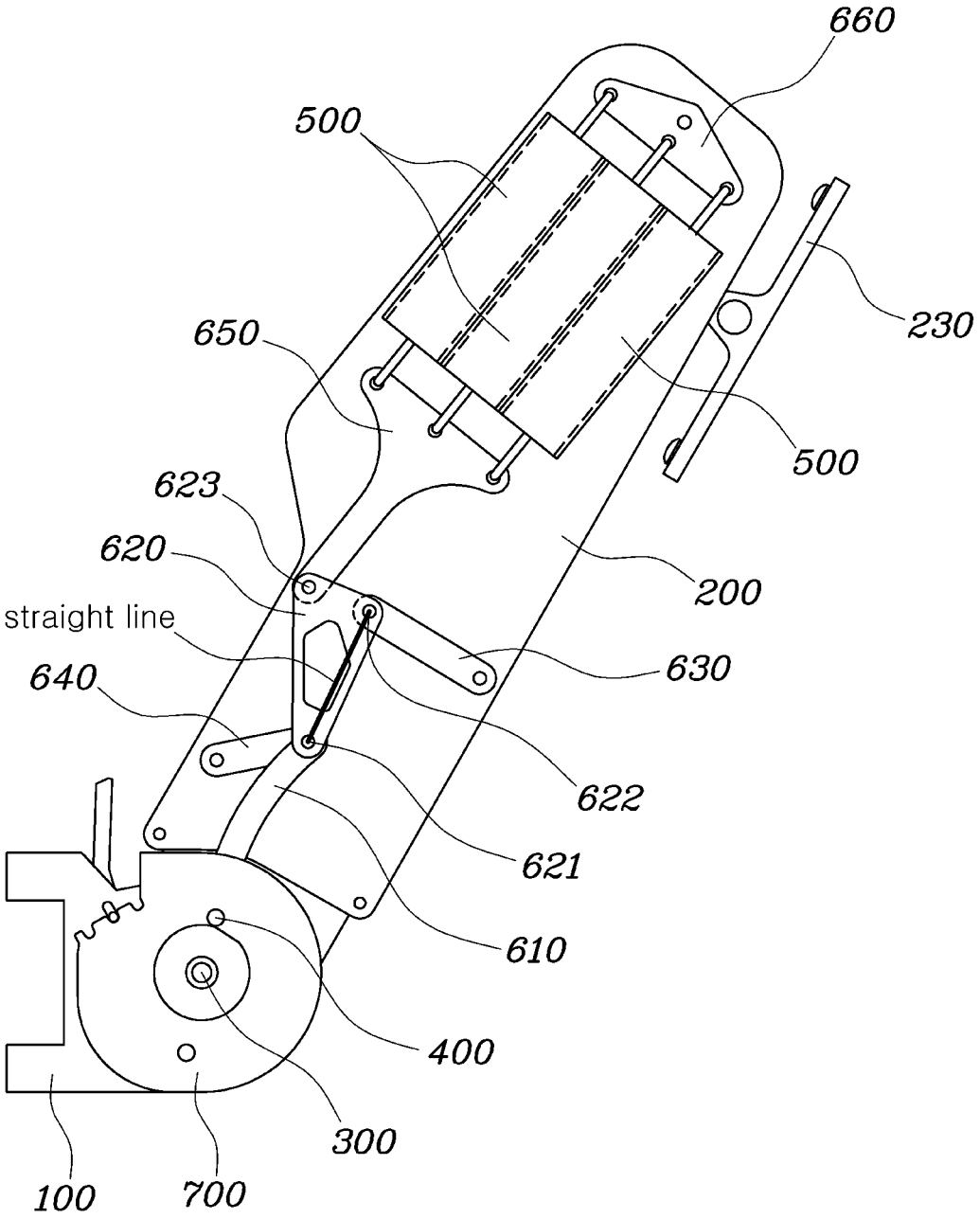
FIG. 1 is a view showing the interior of an upper arm module of a wearable muscular strength assisting apparatus according to an embodiment of the present disclosure.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-of", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

In the following description, the structural or functional description specified to exemplary embodiments according to the concept of the present disclosure is intended to describe the exemplary embodiments, so it should be understood that the present disclosure may be variously embodied, without being limited to the exemplary embodiments.

The exemplary embodiments according to the concept of the present disclosure may be variously modified and may have various shapes, so examples of which are illustrated in the accompanying drawings and will be described in detail with reference to the accompanying drawings. However, it should be understood that the exemplary embodiments according to the concept of the present disclosure are not limited to the embodiments which will be described hereinbelow with reference to the accompanying drawings, but various modifications, equivalents, additions and substitutions are possible, without departing from the scope and spirit of the disclosure.

It will be understood that, although the terms first, second, etc. may be used herein to describe various elements, these elements should not be limited by these terms. These terms are only used to distinguish one element, from another element. For instance, a first element discussed below could be termed a second element without departing from the teachings of the present disclosure. Similarly, the second element could also be termed the first element.

It will be understood that when an element is referral to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Further, the terms used herein to describe a relationship between elements, for example, "between", "directly between", "adjacent", or "directly adjacent" should be interpreted in the same manner as those described above.

Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinbelow, an exemplary embodiment of the present disclosure will be described in detail with reference to the accompanying drawings. Throughout the drawings, the same reference numerals will refer to the same or like parts.

Figure 2:
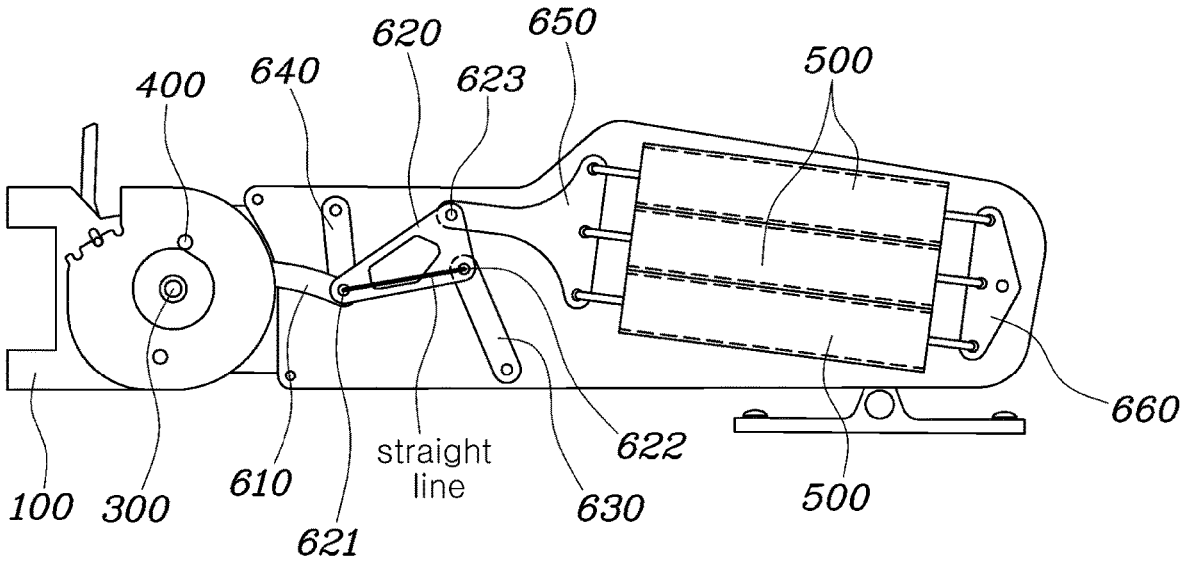
FIGS. 2 to 3 are views showing states of a rotation process of the upper arm module of the wearable muscular strength assisting apparatus according to the embodiment of the present disclosure.
Figure 3:
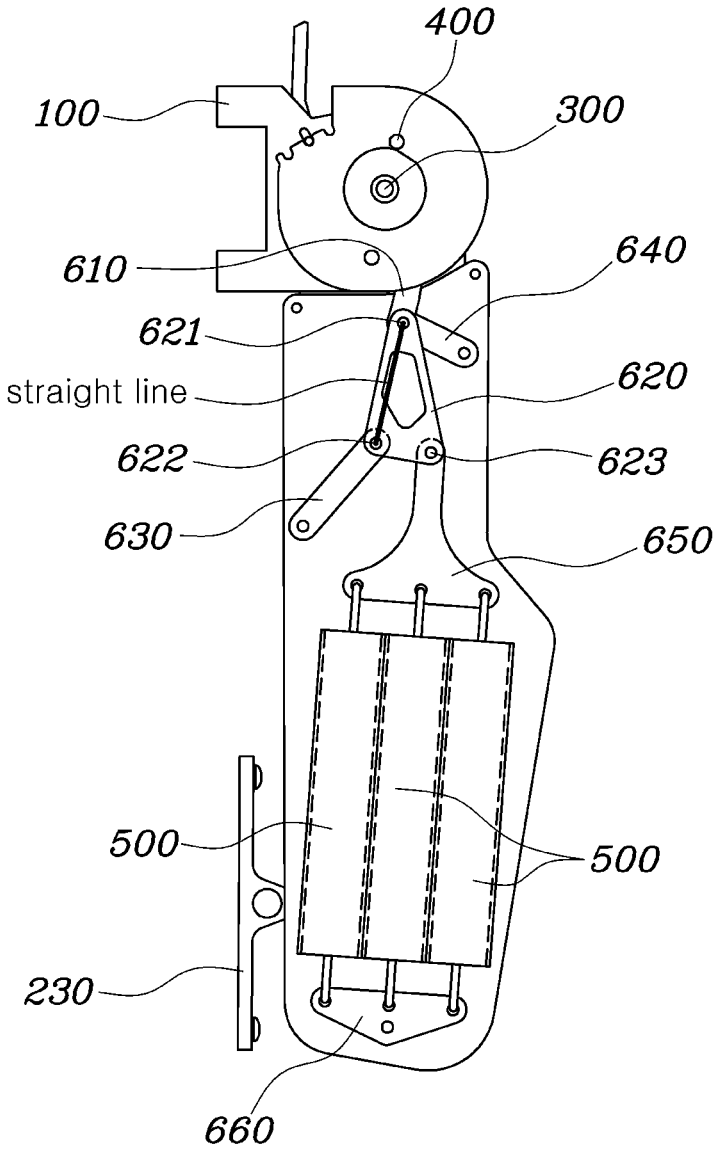

FIG. 1 is a view showing the interior of an upper arm module of a wearable muscular strength assisting apparatus 1000 according to an embodiment of the present disclosure; and FIGS. 2 to 3 are views showing states of a rotation process of the upper arm module of the wearable muscular strength assisting apparatus 1000 according to the embodiment of the present disclosure.

With reference to FIGS. 1 to 3, the upper arm module of the wearable muscular strength assisting apparatus 1000 according to the embodiment of the present disclosure includes: a base part 100 fixedly connected to a wearer's body, and positioned to correspond to an upper end portion of a wearer's upper arm; an upper arm part 200 being configured such that a first end thereof is coupled to the base part 100 to be rotatable about a fixed point 300, extending to correspond to the wearer's upper arm, and being coupled to the wearer's upper arm to apply a rotational torque to the wearer's upper arm; a first link 610 configured such that a first end thereof is rotatably coupled to the base part 100 at a point of application 400 spaced apart from the fixed point 300; a second link 620 extending on a plane on which the upper arm part 200 extends, and rotatably coupled to a second end of the first link 610 at a first point 621; a third link 630 coupled to the second link 620 at a second point 622 spaced apart from the first point 621 of the second link 620 to guide movement of the second point 622; and an elastic body 500 being configured such that a first end thereof is coupled to the upper arm part 200 at a position spaced apart from the first end of the upper arm part 200 in an extension direction of the upper arm part 200, and a second end thereof is coupled to the second link 620 at a third point 623 spaced apart from the first point 621 and the second point 622 of the second link 620, and generating an elastic force by deformation.

The base part 100 is located at the shoulder of the wearer and may be located at the center of rotation of the wearer's upper arm to correspond to the upper end portion of the wearer's upper arm. In particular, the fixed point 300 may be located at the center of rotation of the wearer's upper arm.

The upper arm part 200 corresponding to the wearer's upper arm may be coupled to the base part 100 to be rotatable about the fixed point 300 while being positioned at a side of the wearer's upper arm so as to simulate motion of the wearer's upper arm rotating upward or downward about the upper end portion thereof.

The first end of the elastic body 500 is coupled to the upper arm part 200, and particularly, may be fixedly coupled to the second end of the upper arm part 200 while being spaced apart in the extension direction of the upper arm part 200. As described below, the second end of the elastic body 500 can be moved up or down, so that the first end of the elastic body 500 may be rotatably coupled to the upper arm part 200.

The elastic body 500 is deformed in length as the upper arm part 200 is rotated about the fixed point 300, and the elastic force generated thereby can be varied. In particular, the elastic body may be configured such that the deformation does not occur so that the elastic force becomes zero at a predetermined rotation angle at which the upper arm part 200 is rotated about the fixed point 300, and as the distance between the first end and the second end thereof increases, a tensile force can be generated by deformation.

Thus, by the magnitude and the direction of the elastic force generated in the elastic body 500 as the upper arm part 200 is rotated about the fixed point 300 with respect to the base part 100, the rotational torque applied to the base part 100 and the upper arm part 200 can be varied.

In particular, in the base part 100, a rotational torque ($\tau=(r)X(F)=|r||F|\sin\theta$) in a downward rotational direction is generated, and as a reaction to this, in the upper arm part 200, a rotational torque in an upward rotational direction is generated with the same magnitude.

Accordingly, only with the configuration of the simple connecting links 610, 620, 630, 640, 650, and 660, and the elastic body 500, it is possible to generate rotational torque that rotates the upper arm part 200 of the wearer upwardly, and it is possible to form a profile of rotational torque so as to vary the rotational torque according to the angle of the upper arm part 200. In particular, durability and assemblability can be improved by using links without using wires and cams.

In particular, the connecting links 610, 620, 630, 640, 650, and 660 may include: the first link 610 configured such that the first end thereof is rotatably coupled to the base part 100 at the point of application 400 spaced apart from the fixed point 300; the second link 620 extending on the plane on which the upper arm part 200 extends, and rotatably coupled to the second end of the first link 610 at the first point 621; and the third link 630 coupled to the second link 620 at the second point 622 spaced apart from the first point 621 of the second link 620 to guide movement of the second point 622.

In particular, since the point of application 400 is disposed spaced apart from the fixed point 300, when the upper arm part 200 is rotated about the fixed point 300 with respect to the base part 100, the first end of the first link 610 is rotated around the point of application 400, whereby the second end of the first link 610 can be moved while the distance from the fixed point 300 is varied.

The second link 620 may be rotatably coupled to the second end of the first link 610 at the first point 621, may be coupled to the upper aim part 200 such that the movement of the second point 622 spaced apart from the first point 621 is guided as the upper aim part 200 is rotated about the fixed point 300, and may be coupled to the second end of the elastic body 500 at the third point 623 spaced apart from the first point 621 and the second point 622.

The third link 630 is coupled to the second link 620 at the second point 622 of the second link 620 to guide the movement of the second link 620. In particular, as the upper arm part 200 is rotated around the base part 100, it is possible to guide the path along which the second point 622 of the second link 620 is moved.

The first end of the elastic body 500 may be coupled to the second link 620 at the third point 623 spaced apart from the first point 621 and the second point 622, and the second end of the elastic body 500 may be coupled to the second end of the upper arm part 200. Thus, as the upper arm part 200 is rotated around the base part 100, the length of the elastic body 500 can be varied by the movement of the second link 620 according to the guide of the first link 610 and the third link 630. Accordingly, the elastic body 500 can generate an elastic force that varies depending on the rotation angle of the upper arm part 200.

According to the present disclosure, only with the simple connecting links and the elastic body without using wires and cams, it is possible to realize a torque profile that varies the rotational torque that rotates the upper arm part 200 of the wearer upward according to the angle of the upper arm part 20.

In particular, the first end of the third link 630 may be rotatably coupled to the upper arm part 200, and the second end of the third link 630 may be rotatably coupled to the second link 620 at the second point 622 spaced apart from the first point 621 of the second link 620.

While the second link 620 is moved by the first link 610 as the upper arm part 200 is rotated around the base part 100, the second point 622 of the second link 620 can be guided by the third link 630.

In an embodiment, with the third link 630 disposed at a position under the first link 610 and the second link 620, the first end of the third link may be rotatably coupled to the upper arm part 200, and the second end of the third link may be rotatably coupled to the second point 622 of the second link 620.

The upper aim module may further include a fourth link 640 configured such that a first end thereof is rotatably coupled to the upper arm part 200, and a second end is rotatably coupled to the first link 610 at a position spaced apart from the first end of the first link 610.

As the first link 610 is coupled to the fourth link 640 at a position spaced apart from the first end thereof, the rotation can be restrained with the first end fixed to the point of application 400. Thus, the movement of the second end of the first link 610 and the first point 621 of the second link 620 coupled thereto can be guided.

In an embodiment, with the fourth link 640 disposed at a position above the first link 610 and the second link 620, the first end of the fourth link may be rotatably coupled to the upper arm part 200, and the second end of the fourth link may be rotatably coupled to the first link 610.

In particular, the second end of the fourth link 640 may be concurrently coupled to the first link 610 and the second link 620 at the first point 621 of the second link 620. In other words, at the first point 621, the second end of the fourth link 640 may be concurrently coupled to the coupling point of the second link 620 and the first link 610.

Thus, as the upper arm part 200 is rotated around the base part 100, the movement of the first point 621 of the second link 620 can be guided by the rotation of the fourth link 640.

The third point 623 spaced apart from the first point 621 and the second point 622 of the second link 620 is determined with no degree of freedom as the positions of the first point 621 and the second point 622 are determined, thereby forming the deformation profile of the elastic body 500.

Further, the point of application 400 may be disposed in the base part 100 at a position above the fixed point 300, so the direction from the fixed point 300 to the point of application 400 may be an upward sloping direction from the ground.

The magnitude of the rotational torque applied to the upper arm part 200 or to the base part 100 is determined by the magnitude of the elastic force, and an angle between the direction from the point of application 400 to the fixed point 300 and the direction to which the elastic force is applied from the point of application 400.

In particular, the magnitude of the rotational torque is proportional to the sine of the angle between the direction from the point of application 400 to the fixed point 300 and the direction to which the elastic force is applied from the point of application 400. The point of application 400 may be disposed a position higher than the fixed point 300 such that the sine of the angle between the direction from the point of application 400 to the fixed point 300 and the direction to which the elastic force is applied from the point of application 400 increases gradually as the upper arm part 200 is rotated about the fixed point 300, has a maximum value when the wearer's upper arm is near a predetermined angle with respect to the ground, and then decreases again.

In other words, the point of application 400 may be disposed such that the direction from the fixed point 300 toward the point of application 400 is upwardly inclined from the ground, and thus, the angle between the direction from the point of application 400 toward the fixed point 300 and the direction to which the elastic force is applied from the point of application 400 approaches 0 degrees with the upper arm part 200 maximally rotated upwardly from the ground, approaches 90 degrees with the upper arm part 200 near at the predetermined angle, and approaches 180 degrees with the upper arm part 200 maximally rotated downwardly.

The upper arm module may further include: a fifth link 650 configured such that a first end thereof is rotatably coupled to the second link 620 between the second link 620 and the elastic body 500, and a second end thereof is coupled to the second end of the elastic body 500; and a sixth link 660 configured such that a first end thereof is rotatably coupled to the upper arm part 200 between the elastic body 500 and the upper arm part 200, and a second end thereof is coupled to the first end of the elastic body 500.

The fifth link 650 and the sixth link 660 are rotatably coupled to the third point 623 of the second link 620, and the upper arm part 200, respectively, so that the length of the elastic body 500 can be smoothly changed according to the change in length between the third point 623 of the second link 620, the upper arm part 200, and the first end of the elastic body 500 according to the rotation of the upper arm part 200 about the fixed point 300.

The elastic body 500 may be constituted by a plurality of springs with opposite ends thereof being coupled to the fifth link 650 and the sixth link 660, respectively, and the second end of the fifth link 650 and the second end of the sixth link 660 may extend along a direction in which the plurality of springs is disposed.

Thus, it is possible to prevent breakage such as wire breakage by using a durable spring as the elastic body 500, and it is possible to easily change the elastic force and the magnitude of the rotational torque thereby by replacing the spring.

In particular, the elastic body 500 may be constituted by a plurality of springs with opposite ends thereof being coupled to the fifth link 650 and the sixth link 660, respectively, and the second end of the fifth link 650 and the second end of the sixth link 660 may extend along the direction in which the plurality of springs is disposed. The plurality of springs may be of the same initial length, and may be arranged such that the magnitudes of the elastic forces according to change in length are symmetrical to each other.

Thus, the elastic force generated in the plurality of springs arranged on top of each other can be uniformly applied to the fifth link 650 and the sixth link 660.

Figure 4:
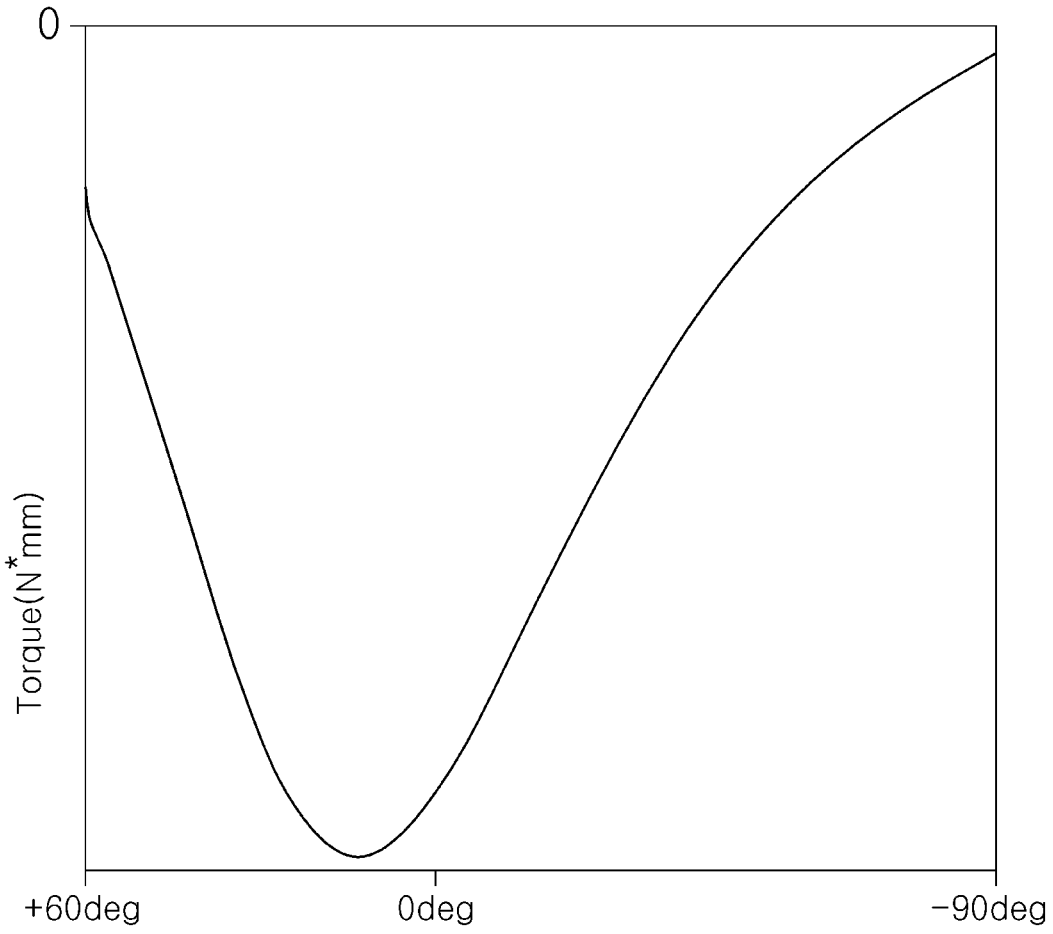
FIG. 4 is a view showing a torque profile of the upper arm module of the wearable muscular strength assisting apparatus according to the embodiment of the present disclosure.
Figure 5:
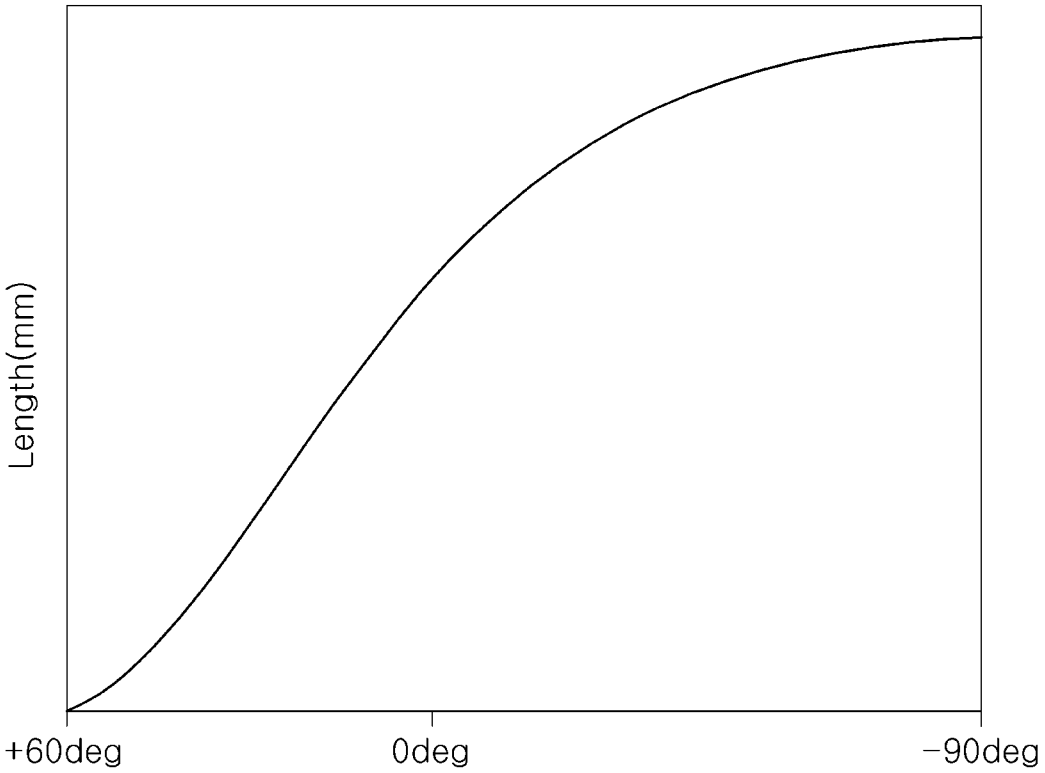
FIG. 5 is a view showing a deformation profile of an elastic body included in the upper aim module of the wearable muscular strength assisting apparatus according to the embodiment of the present disclosure.

FIG. 4 is a view showing a torque profile of the upper arm module of the wearable muscular strength assisting apparatus 1000 according to the embodiment of the present disclosure; FIG. 5 is a view showing a deformation profile of the elastic body 500 included in the upper arm module of the wearable muscular strength assisting apparatus 1000 according to the embodiment of the present disclosure; and FIG. 6 is a view showing a torque profile of the upper arm module of the wearable muscular strength assisting apparatus 1000 according to the embodiment of the present disclosure and a torque profile according to a prior art.

Figure 6:
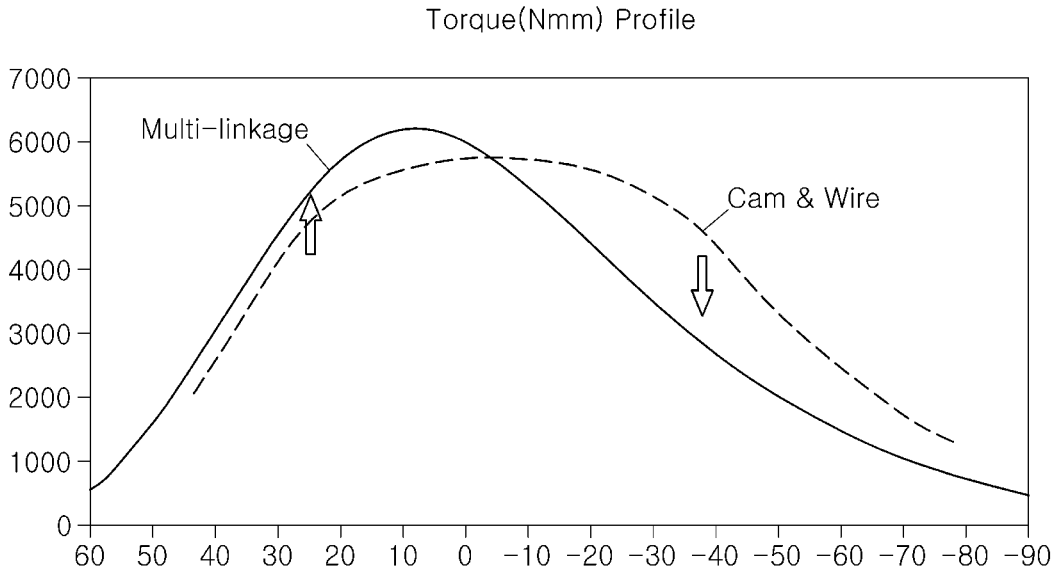
FIG. 6 is a view showing a torque profile of the upper arm module of the wearable muscular strength assisting apparatus according to the embodiment of the present disclosure and a torque profile according to a prior art.

With further reference to FIGS. 4 to 6, the rotational torque generated by the elastic force of the elastic body 500 may be varied as the upper arm part 200 is rotated around the fixed point 300, and may have a profile in which the magnitude of the rotational torque increases gradually as the upper arm part 200 is rotated downward with respect to the base part 100, has a maximum value at a predetermined angle with respect to the ground, and then decreases again.

Herein, the torque profile graph of FIG. 4 is mapped using negative numbers less than zero.

As shown in FIG. 5, the deformation profile of the elastic body 500 may be configured such that the elastic force of the elastic body 500 is rapidly increased until the wearer's upper arm is moved down to a predetermined angle (for example, near 0 degrees) with respect to the ground, and is slowly increased at an angle of the predetermined angle or less.

The wearable muscular strength assisting apparatus 1000 supporting the wearer's upper arm is required to be designed such that in order to compensate the wearer's upper arm for gravity, the rotational torque rotating upward is increased as the wearer's upper arm is moved downward in the state where the wearer's upper arm is upwardly inclined at a first predetermined fixed angle (for example, +60 degrees) with respect to the ground. Thus, it is possible to compensate for the gravity acting on the wearer's upper arm to support the wearer's upper arm to maintain the upwardly rotated state.

Further, the wearable muscular strength assisting apparatus is required to be designed such that the rotational torque rotating upward is decreased as the wearer's upper arm is moved down from a predetermined angle (for example, near 0 degrees) to a second predetermined fixed angle (for example, −90 degrees). Thereby, the wearer is not interfered with in the movement of lowering the upper arm.

Accordingly, in contrast to the Cam & Wire torque profile according to the prior art shown by the dotted line in FIG. 6, the Multi-linkage torque according to the present disclosure is configured such that the magnitude has a maximum value at an angle where the wearer's upper arm is disposed high, and has a small value at an angle where the wearer's upper arm is disposed low so as to favor the lowering motion of the upper arm.

To achieve this, with reference again to FIGS. 1 to 3, the third point 623 of the second link 620 may be spaced apart from a straight line connecting the first point 621 and the second point 622 such that the first point 621, the second point 622, and the third point 623 form a triangle, and the first point 621 and the second point 622 of the second link 620 may be moved such that the second link 620 is rotated while being translated toward the fixed point as the upper arm part 200 is rotated downward around the fixed point 300.

In other words, the third point 623 is spaced apart from the straight line connecting the first point 621 and the second point 622 so that the first point 621, the second point 622, and the third point 623 form a triangle, and the second link 620 is guided by the movement of the first point 621 and the second point 622, so that a rotational motion along with the translational movement is generated in the second link 620 as the movement of the first point 621 and the second point 622 is guided, thereby guiding the position of the third point 623.

In particular, as the upper arm part 200 is rotated downward around the fixed point 300 within an angle range greater than a predetermined angle with respect to the ground, the second link 620 may be rotated in a direction in which the third point 623 is away from the first end of the upper arm part 200.

Thus, as the upper arm part 200 approaches the predetermined angle within the angle range greater than the predetermined angle, the deformation of the elastic body 500 is increased. Accordingly, the rotational torque between the upper arm part 200 and the base part 100 is rapidly increased.

Further, as the upper arm part 200 is rotated downward around the fixed point 300 within an angle range smaller than a predetermined angle with respect to the ground, the second link 620 may be rotated in a direction in which the third point 623 approaches the first end of the upper arm part 200.

Thus, as the upper arm part 200 is away from the predetermined angle within the angle range smaller than the predetermined angle, the deformation of the elastic body 500 is decreased. Accordingly, the rotational torque between the upper arm part 200 and the base part 100 is rapidly decreased.

In an embodiment, the third point 623 of the second link 620 may be positioned above the straight line connecting the first point 621 and the second point 622, and as the upper arm part 200 is rotated downward around the fixed point 300, the first point 621 of the second link 620 may be moved downward while being moved toward the fixed point, and may be moved upward, and the second point 622 may be gradually and quickly moved downward while being moved toward the fixed point.

In particular, the third point 623 of the second link 620 may be positioned at a position above a straight line connecting the point of application 400 and the first end of the elastic body 500.

In particular, with the upper arm part 200 within the angle range greater than the predetermined angle with respect to the ground, the first point 621 of the second link 620 may be moved downward while being moved toward the fixed point, and the second point 622 may be gradually moved downward while being moved toward the fixed point Thereby, as the second link 620 is moved toward the fixed point, the third point 623 is rotated in a direction away from the first end of the elastic body 500 to increase the effect of the translational motion of the second link 620 is increased, and thus the elastic force of the elastic body 500 can be rapidly increased.

On the contrary, with the upper arm part 200 within the angle range smaller than the predetermined angle with respect to the ground, the first point 621 of the second link 620 may be moved upward while being moved toward the fixed point, and the second point 622 may be rapidly moved downward while being moved toward the fixed point. Thereby, as the second link 620 is moved toward the fixed point, the third point 623 is rotated in a direction approaching the first end of the elastic body 500 to offset or decrease the effect of the translational motion of the second link 620, and thus, the elastic force of the elastic body 500 can be slowly increased.

Figure 7:
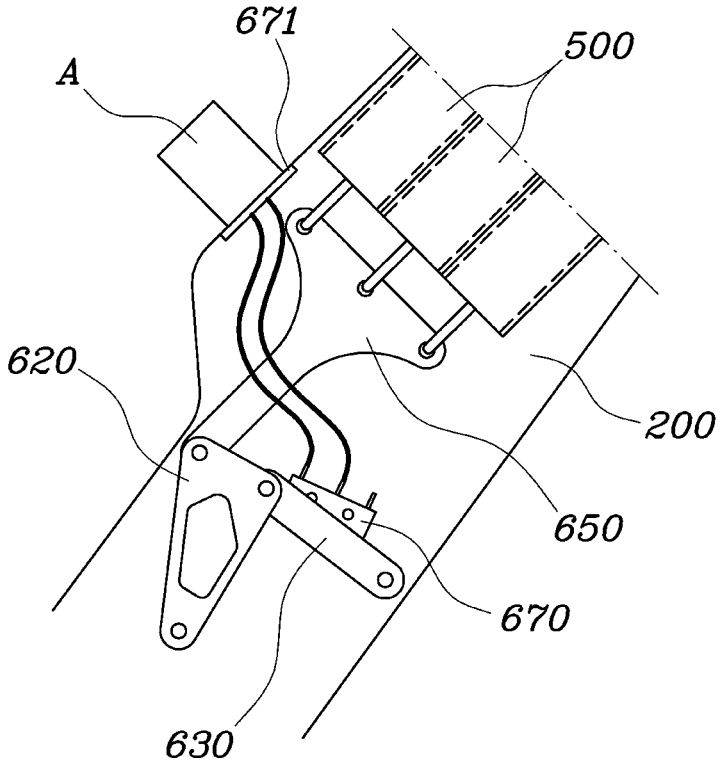
FIG. 7 is an enlarged view showing the interior of the upper arm module of the wearable muscular strength assisting apparatus according to the embodiment of the present disclosure.

FIG. 7 is an enlarged view showing the interior of the upper arm module of the wearable muscular strength assisting apparatus 1000 according to the embodiment of the present disclosure.

With further reference to FIG. 7, the third link 630 may further include a micro switch 670 that is operated to be grounded or ungrounded as the third link 630 is rotated about the first end, wherein the micro switch 670 may be coupled to an external device A through a connector 671 provided in the upper arm part 200.

The micro switch 670 may be connected to the connector 671 via wiring inside the upper aim part 200.

The micro switch 670 may count the number of times being grounded or ungrounded. The connector may be provided exposed from the upper or lower portion of the upper arm part 200. Thus, the external device A can be easily connected to the connector 671 exposed outside the upper arm part 200, and can count the number of times the upper arm part 200 is rotated if necessary.

As another embodiment, the micro switch 670 may be disposed at the fourth link 640 so as to be grounded or ungrounded in response to the rotation of the fourth link 640.

Figure 8:
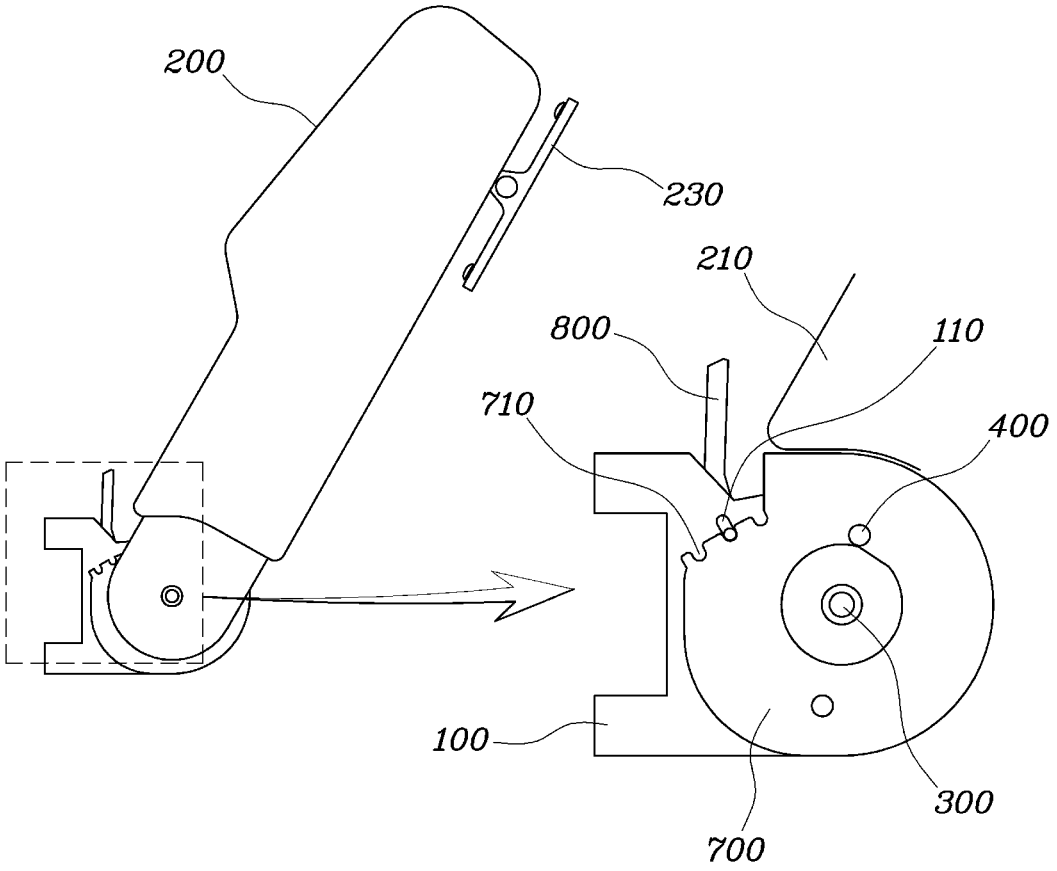
FIG. 8 is a front view showing the exterior of the upper arm module of the wearable muscular strength assisting apparatus according to the embodiment of the present disclosure.
Figure 9:
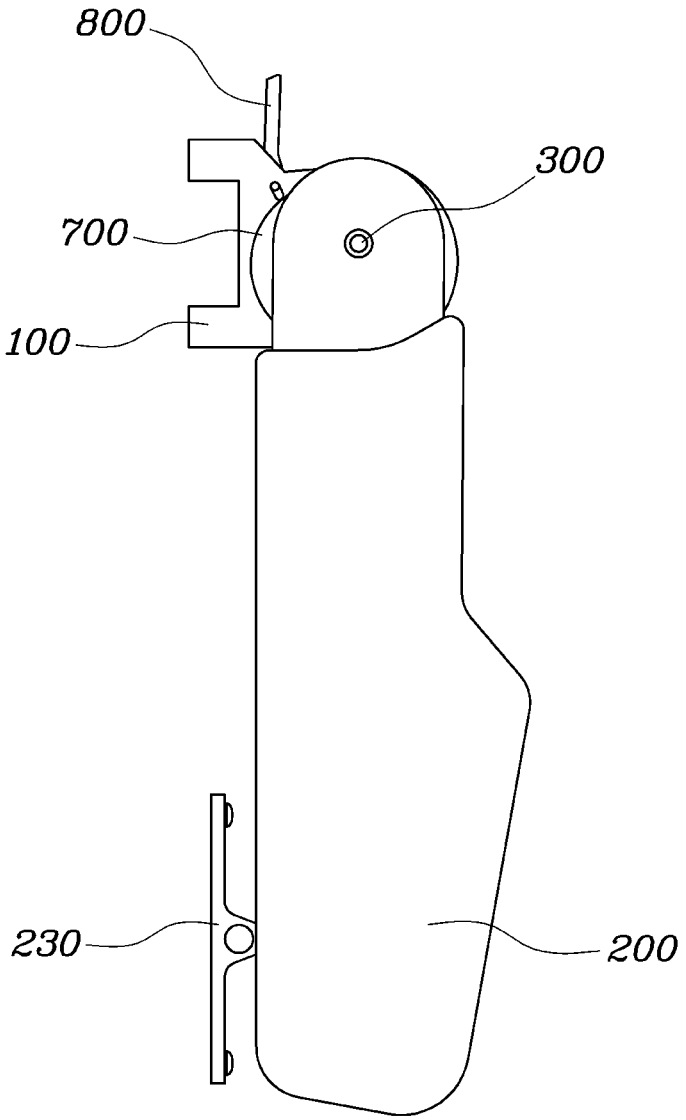
FIG. 9 is a view showing a state where a locking mechanism of the upper arm module of the wearable muscular strength assisting apparatus according to the embodiment of the present disclosure is released.

FIG. 8 is a front view showing the exterior of the upper arm module of the wearable muscular strength assisting apparatus 1000 according to the embodiment of the present disclosure; and FIG. 9 is a view showing a state where a locking mechanism 800 of the upper arm module of the wearable muscular strength assisting apparatus 1000 according to the embodiment of the present disclosure is released.

With reference to FIGS. 8 to 9, the upper aim module may further include a rotatable part 700 relatively rotatably coupled to the base part 100 about the fixed point 300, and configured such that rotation of the rotatable part 700 relative to the base part 100 is restrained when locked by a locking mechanism 800, wherein the first link 610 is rotatably coupled to the rotatable part 700 at the point of application 400 so that the connecting links 610, 620, 630, 640, 650, and 660, and the upper arm part 200 are rotated simultaneously as the rotatable part is rotated with respect to the base part 100.

In other words, the first end of the first link 610 may be directly coupled to the base part 100, or may be coupled thereto via the rotatable part 700.

The rotatable part 700 is coupled to the base part 100 to be rotatable about the fixed point 300, rotation of the rotatable part 700 relative to the base part 100 is restrained when locked by the locking mechanism 800, and the rotatable part can be freely rotated with respect to the base part 100 when the locked state by the locking mechanism 800 is released.

The locking mechanism 800 may allow the rotatable part 700 to be locked to the base part 100 at multiple rotation angle points. The rotatable part 700 can be locked to the base part 100 at multiple rotation angle points, and when the rotatable part 700 is rotated with respect to the base part 100 about the fixed point 300, the connecting links 610, 620, 630, 640, 650, and 660, and the upper arm part 200 are simultaneously rotated along with the rotatable part 700, thereby having an effect that the torque profile of the rotational torque applied to the upper arm part 200 is moved.

In other words, there is an effect that the torque profile is moved over an entire range of angles including the predetermined angle with a maximum rotational torque. Accordingly, the angular range, in which the torque profile is formed, is shifted according to the wearer's desire to implement the rotational torque at a desired angle.

In particular, the locking mechanism 800 is slidably coupled to the base part 100, and the rotatable part 700 is provided with a plurality of coupling grooves 710 spaced apart from each other in the rotating direction with respect to the base part 100, wherein the locking mechanism 800 is inserted in the coupling groove 710 and engaged therewith, so rotation of the rotatable part 700 relative to the base part 100 can be restrained.

The locking mechanism 800 may slide in a sliding groove 110 formed through the base part 100 to be engaged with the coupling groove 710 of the rotatable part 700 or released from the coupling groove 710. An elastic force may be applied in a direction in which the locking mechanism 800 is inserted into the coupling groove 710 through a separate elastic body (not shown) having the elastic force.

The base part 100 and the upper arm part 200 may further include a support 230 being provided at an outer side of the wearer's upper arm and extending inwardly of the wearer's upper arm in the upper arm part 200 to wrap the lower portion of the wearer's upper arm.

The wearer's upper arm can be supported thereunder by the support 230, and thus, the rotational torque applied to the upper arm part 200 can be stably applied to the wearer's upper arm.

Figure 10:
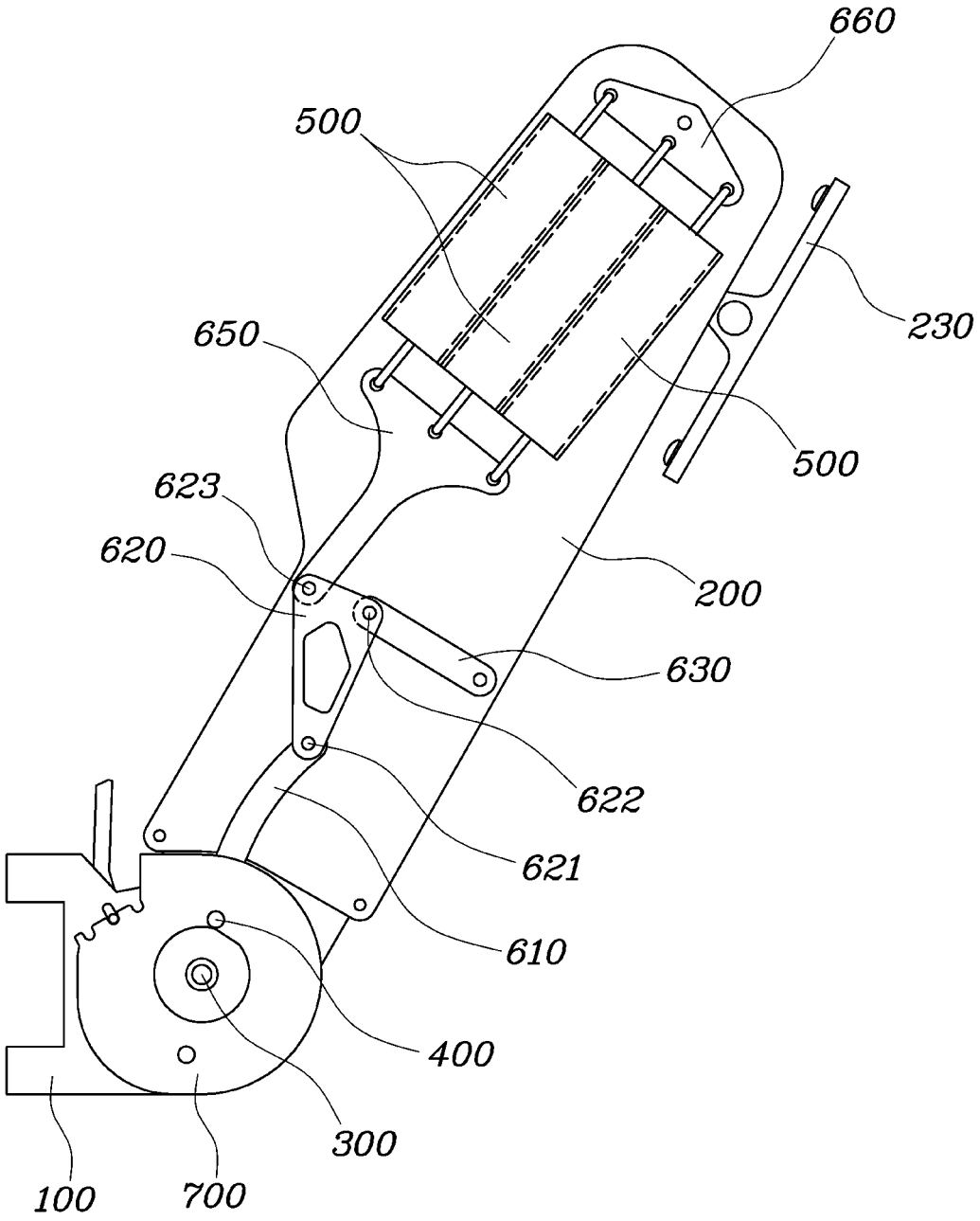
FIG. 10 is a view showing the interior of the upper aim module of the wearable muscular strength assisting apparatus according to another embodiment of the present disclosure.

FIG. 10 is a view showing the interior of the upper arm module of the wearable muscular strength assisting apparatus 1000 according to another embodiment of the present disclosure.

As shown in FIG. 10, the upper arm module of the wearable muscular strength assisting apparatus 1000 according to another embodiment of the present disclosure may include the base part 100, the upper arm part 200, the first link 610, the second link 620, the third link 630, and the elastic body 500, excluding the configuration of the fourth link 640.

In other words, the another embodiment excludes the configuration of the fourth link 640 that guides the second end of the first link 610 or directly guides the first point 621 of the second link 620, and the second end of the first link 610 and the first point 621 of the second link 620 may be positioned at a position where the deformation of the elastic body 500 is minimized while being rotated about the first end of the first link 610.

According to this, since the first point 621 of the second link 620 cannot be directly guided, the rotational torque profile and the deformation profile of the elastic body 500 are variable, but the effect according to the present disclosure can be equally implemented.

Figure 11:
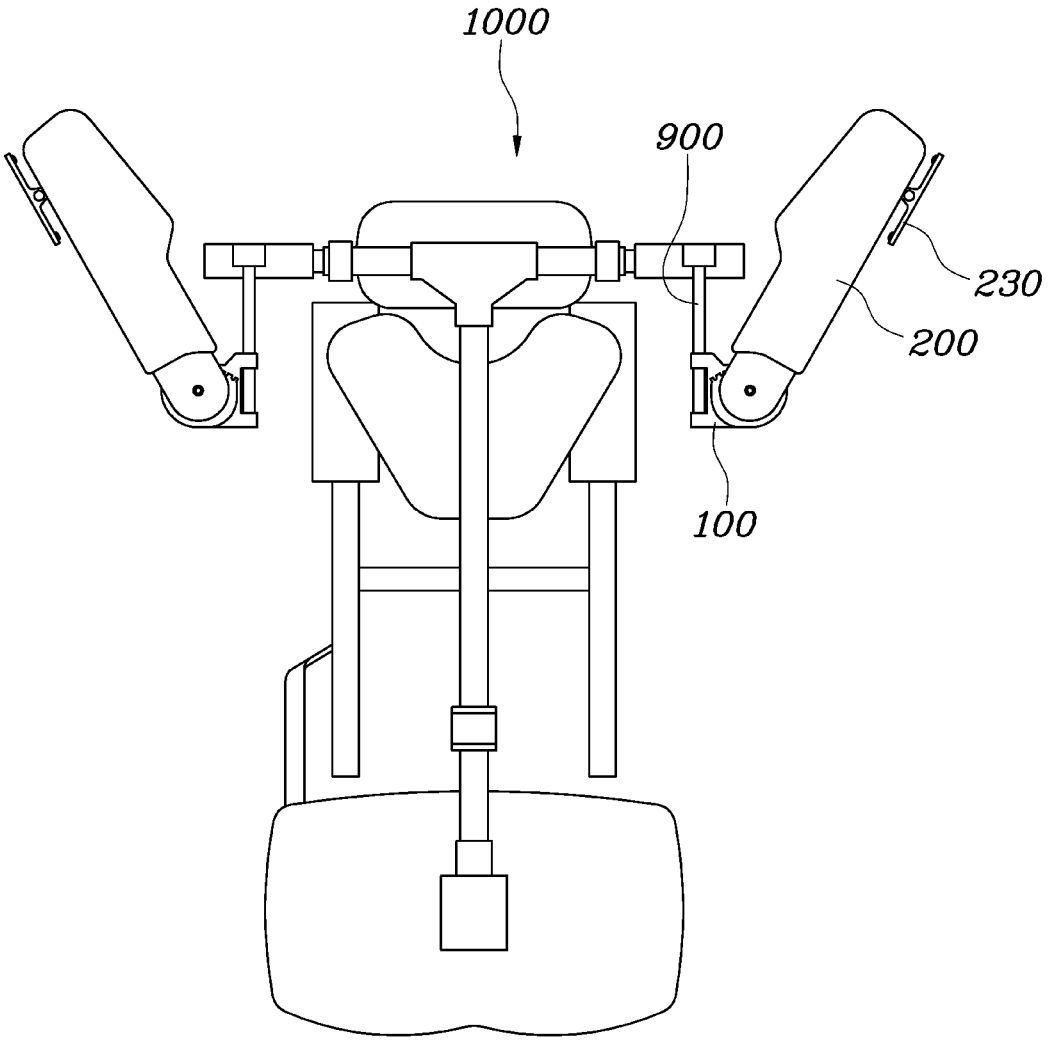
FIG. 11 is a rear view showing a wearable muscular strength assisting apparatus including the upper aim module according to an embodiment of the present disclosure.

FIG. 11 is a rear view showing a wearable muscular strength assisting apparatus 1000 including the upper arm module according to an embodiment of the present disclosure.

With reference to FIG. 11, the wearable muscular strength assisting apparatus 1000 including the upper arm module of the wearable muscular strength assisting apparatus 1000 according to the embodiment of the present disclosure may be configured such that the base part 100 is coupled to a wearer's torso through a plurality of fastening mechanisms.

In particular, the wearable muscular strength assisting apparatus includes fastening mechanisms coupled to wearer's shoulder, waist, and the like through harnesses or the like, and the upper arm module of the present disclosure is coupled to the wearer's torso through the fastening mechanisms to be fixed to the wearer's torso.

In particular, the base part 100 may be coupled to the plurality of fastening mechanisms to be rotatable about a rotating shaft 900 extending in the up and down direction of the wearer.

The rotating shaft 900 may be fixed to the wearer's torso by being coupled to the plurality of fastening mechanisms, be disposed at the back of the wearer, and extend in the up and down direction. The base part 100 may be rotatably coupled to the rotating shaft 900 disposed at the back of the wearer, and may extend from the rotating shaft 900 to the outer side of the wearer's upper arm.

Accordingly, the wearer can rotate the upper arm upward or downward, and also, can freely perform internal rotation, and abduction movements.

Although a preferred embodiment of the present disclosure has been described for illustrative purposes, those skilled in the art will appreciate that various modifications, additions and substitutions are possible, without departing from the scope and spirit of the disclosure as disclosed in the accompanying claims.

What is claimed is:

1. An upper arm module of a wearable muscular strength assisting apparatus, the upper arm module comprising:

a base part fixedly connected to a wearer's body, and positioned to correspond to an upper end portion of the wearer's upper arm;

an upper arm part being configured such that a first end of the upper arm part is coupled to the base part to be rotatable about a fixed point, extending to correspond to the wearer's upper arm, and including a support which is adapted to support the wearer's upper arm to apply a rotational torque to the wearer's upper arm;

a first link configured such that a first end of the first link is rotatably coupled to the base part at a point of application spaced apart from the fixed point;

a second link extending on a plane on which the upper arm part extends, and being rotatably coupled to a second end of the first link at a first point;

a third link coupled to the second link at a second point spaced apart from the first point of the second link to guide movement of the second point; and an elastic body being configured such that a first end of the elastic body is coupled to the upper arm part at a position spaced apart from the first end of the upper arm part in an extension direction of the upper arm part, and a second end of the elastic body is coupled to the second link at a third point spaced apart from the first point and the second point of the second link, and generating an elastic force by deformation of the elastic body.

2. The upper arm module of claim 1, wherein the third link is configured such that a first end of the third link is rotatably coupled to the upper arm part, and a second end of the third link is rotatably coupled to the second link at the second point spaced apart from the first point of the second link.

3. The upper arm module of claim 1, further comprising:

a fourth link configured such that a first end of the fourth link is rotatably coupled to the upper arm part, and a second end of the fourth link is rotatably coupled to the first link at a position spaced apart from the first end of the first link.

4. The upper arm module of claim 3, wherein the second end of the fourth link is concurrently coupled to the first link and the second link at the first point of the second link.

5. The upper arm module of claim 1, wherein the third link further includes a micro switch that is operated to be grounded or ungrounded as the third link is rotated about a first end of the third link, wherein the micro switch is coupled to an external device through a connector provided in the upper arm part.

6. The upper arm module of claim 1, wherein the point of application is disposed in the base part at a position above the fixed point, so a direction from the fixed point to the point of application is an upward sloping direction from a ground.

7. The upper arm module of claim 1, further comprising:

a fifth link configured such that a first end of the fifth link is rotatably coupled to the second link between the second link and the elastic body, and a second end of the fifth link is coupled to the second end of the elastic body; and a sixth link configured such that a first end of the sixth link is rotatably coupled to the upper arm part between the elastic body and the upper arm part, and a second end of the sixth link is coupled to the first end of the elastic body.

8. The upper arm module of claim 7, wherein the elastic body is constituted by a plurality of springs with opposite ends of the elastic body being coupled to the fifth link and the sixth link, respectively, and the second end of the fifth link and the second end of the sixth link extend along a direction in which the plurality of springs is disposed.

9. The upper arm module of claim 1, wherein the rotational torque is varied as the upper arm part is rotated about the fixed point, and has a profile in which a magnitude of the rotational torque increases gradually as the upper arm part is rotated downward with respect to the base part, has a maximum value at a predetermined angle of the upper arm part with respect to a ground, and decreases as the upper arm part is rotated downward with respect to the base part after the predetermined angle.

10. The upper arm module of claim 1, wherein the third point of the second link is spaced apart from a straight line connecting the first point and the second point such that the first point, the second point, and the third point form a triangle, and the first point and the second point of the second link are moved such that the second link is rotated while being translated toward the fixed point as the upper arm part is rotated downward about the fixed point.

11. The upper arm module of claim 10, wherein as the upper arm part is rotated downward about the fixed point within an angle greater than a predetermined angle of the upper arm part with respect to a ground, the second link is rotated in a direction in which the third point is away from the first end of the upper arm part.

12. The upper arm module of claim 10, wherein as the upper arm part is rotated downward about the fixed point within an angle smaller than a predetermined angle of the upper arm part with respect to a ground, the second link is rotated in a direction in which the third point approaches the first end of the upper arm part.

13. The upper arm module of claim 10, wherein the third point of the second link is disposed above the straight line connecting the first point and the second point with respect to the upper arm part, and as the upper arm part is rotated downward about the fixed point with respect to a ground, the first point of the second link is moved downward or upward with respect to the upper arm part while being moved toward the fixed point, and the second point is moved downward with respect to the upper arm part while being moved toward the fixed point.

14. The upper arm module of claim 1, further comprising:

a rotatable part relatively rotatably coupled to the base part about the fixed point, and configured such that rotation of the rotatable part relative to the base part is restrained when locked by a locking mechanism, wherein the first link is rotatably coupled to the rotatable part at the point of application such that the first link and the upper arm part are rotated simultaneously as the rotatable part is rotated relative to the base part.

15. The upper arm module of claim 14, wherein the locking mechanism allows the rotatable part to be locked to the base part at multiple rotation angle points.

* * * * *